US010367289B2

(12) United States Patent
Sakaguchi

(10) Patent No.: US 10,367,289 B2
(45) Date of Patent: Jul. 30, 2019

(54) TERMINAL CONNECTING STRUCTURE AND CONNECTOR DEVICE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kiyokazu Sakaguchi, Mie (JP)

(73) Assignees: AutoNetworks technologies, Ltd (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/763,142

(22) PCT Filed: Sep. 7, 2016

(86) PCT No.: PCT/JP2016/076237
§ 371 (c)(1),
(2) Date: Mar. 26, 2018

(87) PCT Pub. No.: WO2017/051706
PCT Pub. Date: Mar. 30, 2017

(65) Prior Publication Data

US 2018/0287283 A1 Oct. 4, 2018

(30) Foreign Application Priority Data

Sep. 24, 2015 (JP) ..... 2015-187011

(51) Int. Cl.
*H01R 4/48* (2006.01)
*H01R 13/11* (2006.01)
(Continued)

(52) U.S. Cl.
CPC ..... *H01R 13/11* (2013.01); *H01R 13/15* (2013.01); *H01R 13/187* (2013.01); *H01R 13/193* (2013.01); *H01R 13/631* (2013.01)

(58) Field of Classification Search
CPC ..... H01R 13/193
(Continued)

(56) References Cited

U.S. PATENT DOCUMENTS 1,119,864 A * 12/1914 Ovington ..... H01R 13/193 200/51 R
1,536,688 A * 5/1925 Osborn ..... D06F 75/28 15/DIG. 10
(Continued)

FOREIGN PATENT DOCUMENTS

JP 2000-260521 9/2000
JP 2011-119105 6/2011
(Continued)

OTHER PUBLICATIONS

International Search Report dated Nov. 1, 2016.

*Primary Examiner* — Neil Abrams
(74) *Attorney, Agent, or Firm* — Gerald E. Hespos; Michael J. Porco; Matthew T. Hespos

(57) ABSTRACT

A male terminal (40) has a male connecting portion (41) that is inserted into a female terminal (20) and is placed on a female connecting portion (21). A movable piece (25) is supported by a support (26) of the female connecting portion (21) and can be displaced down relative to the support (26). A female contact (30) is provided on the movable piece (25) and is displaceable between a non-pressing state where the female contact does not press the male connecting portion (41) and a pressing state where the female contact presses the male connecting portion (41). A pressed portion (29) is at a position of the movable piece (25) where a distance from the support (26) exceeds a distance between the support (26)
(Continued)

and the female contact (30). The pressed portion displaces the female contact (30) from the non-pressing state to the pressing state.

6 Claims, 12 Drawing Sheets

(51) Int. Cl.
*H01R 13/193* (2006.01)
*H01R 13/15* (2006.01)
*H01R 13/631* (2006.01)
*H01R 13/187* (2006.01)

(58) Field of Classification Search
USPC ..... 439/263, 259, 260
See application file for complete search history.

(56) References Cited

U.S. PATENT DOCUMENTS 2,075,632 A * 3/1937 Zuckerman ..... H01R 13/193 439/222
2,738,483 A * 3/1956 McLean ..... H01R 13/193 439/263
3,475,717 A * 10/1969 Lane ..... H01R 12/89 439/260
3,643,202 A * 2/1972 Coon ..... H01R 13/193 439/263
4,592,608 A * 6/1986 Ohtsuka ..... H01R 13/631 361/737
4,700,997 A * 10/1987 Strand ..... A61B 5/0416 439/370
5,122,072 A * 6/1992 Arn ..... H01R 4/5008 439/210
6,083,023 A * 7/2000 Kamath ..... H01R 13/62922 439/263
6,244,885 B1 6/2001 Iwahori
7,347,708 B1 * 3/2008 Huang ..... H01R 13/639 439/263
8,113,866 B2 * 2/2012 Gosis ..... H01R 13/62933 439/365
9,722,328 B2 * 8/2017 Wimmer ..... H01R 4/489
2015/0207242 A1 7/2015 Sugiyama et al.

FOREIGN PATENT DOCUMENTS

JP 2013-89421 5/2013
JP 2014-75217 4/2014

* cited by examiner

TERMINAL CONNECTING STRUCTURE AND CONNECTOR DEVICE

BACKGROUND

Field of the Invention

This specification relates to a terminal connecting structure and a connector device.

Description of the Related Art

Japanese Unexamined Patent Publication No. 2013-89421 discloses a terminal connecting structure for connecting a female terminal and a male terminal. The female terminal includes an electrical connecting portion into which a tab on the male terminal is inserted. The electrical connecting portion has a terminal contact portion that is configured to resiliently contact the tab inserted into the electrical connecting portion, and the terminal contact portion includes an engaging piece extending out from the electrical connecting portion.

In the process of inserting the tab into the electrical connecting portion of the female terminal, the terminal contact portion contacts the tab with a resilient biasing force. A housing that holds the male terminal presses the engaging piece immediately before the tab reaches a proper insertion position in the electrical connecting portion. Thus, a contact load of the terminal contact portion on the tab increases. Additionally, the terminal contact portion presses and resiliently contacts the tab before the housing presses the engaging piece. Thus, plating in contact parts of the male terminal and the female terminal may be peeled off in the process of inserting the tab. Expensive silver plating or the like having high wear resistance and low resistance could be used for the contact parts of the terminals, but would increase manufacturing cost. Therefore, a countermeasure against that has been desired.

SUMMARY

This specification is directed to a terminal connecting structure with a male terminal including a male connecting portion and a female terminal including a female connecting portion. The male connecting portion is insertable into and retractable from the female connecting portion, and the inserted male connecting portion is placed on the female connecting portion. A movable portion is supported in an electrically connected state by a support provided on the female connecting portion and is displaceable with the support as a supporting point. A female contact is provided on the movable portion and is displaceable between a non-pressing state where the female contact does not press the male connecting portion inserted into the female connecting portion and a pressing state where the female contact presses the male connecting portion placed on the female connecting portion in a direction intersecting an inserting/retracting direction of the male connecting portion. A pressed portion is provided at a position of the movable portion where a distance from the support is longer than a distance between the support and the female contact. The pressed portion displaces the female contact from the non-pressing state to the pressing state with the support as a supporting point by being pressed.

According to the terminal connecting structure thus configured, the pressed portion is pressed after the male connecting portion is inserted into and placed on the female connecting portion. Thus, the female contact portion is displaced in the direction intersecting the inserting direction of the male connecting portion and displaced from the non-pressing state to the pressing state with respect to the male connecting portion. That is, after the male connecting portion is arranged in the female connecting portion in the non-pressing state where the female contact portion is not pressed against the male connecting portion, the female contact portion presses the male connecting portion in the intersecting direction. Thus, contact parts of the terminals do not slide against each other and do not wear.

Further, if the pressed portion is pressed by a pressing portion, the female contact is displaced from a non-contact position to a contact position by the principle of leverage with the supporting portion as a support, and is pressed against the male connecting portion. Thus, a contact pressure between the terminals can be increased, for example, as compared to the case where a male terminal is inserted into a female terminal including a resilient contact piece to be brought resiliently into contact with the resilient contact piece. In this way, connection reliability between the terminals can be ensured without using expensive plating.

A pressing portion may be relatively displaceable with respect to the female connecting portion between an initial position, where the pressing portion does not press the pressed portion, and an end position, where the pressing portion presses the pressed portion, and the pressing portion may be displaced along a bottom plate of the female connecting portion on which the male connecting portion is placed. According to this configuration, the pressed portion is pressed by the pressing portion, and the pressing portion is configured to be displaced along a placing surface. Thus, the connecting structure can be miniaturized, for example, as compared to a pressing portion configured to press a pressed portion in a direction intersecting a placing surface.

The pressing portion may be formed of metal. According to this configuration, the pressing portion is not likely to be worn by the pressed portion.

The pressing portion may be supported displaceably in a direction along which the male connecting portion is inserted into and retracted from the female connecting portion. According to this configuration, the pressing portion supported on the female connecting portion can be displaced in the inserting/retracting direction of the male connecting portion to press the pressed portion.

A connector device with the above terminal connecting structure and a housing configured to accommodate the female terminal may be such that the pressing portion is provided on the housing, and the pressed portion is pressed by the pressing portion of the housing. Accordingly, the pressed portion can be pressed by the pressing portion of the housing, for example, merely by pressing the female terminal accommodated in the housing against the housing. In this way, the pressed portion can be pressed by the pressing portion without using a dedicated tool or the like.

A connector device with the above terminal connecting structure and a housing configured to accommodate the female terminal may be such that the pressing portion is pressed by the housing. According to this connector device, the pressing portion can be pressed by the housing, for example, merely by pressing the female terminal accommodated in the housing against the housing, and the pressed portion can be pressed by the pressed pressing portion. In this way, the pressed portion can be pressed without using a dedicated tool or the like.

According to this specification, it is possible to suppress the wear of contact parts of both terminals and to ensure connection reliability between both terminals.

DETAILED DESCRIPTION

First Embodiment

Figure 5:
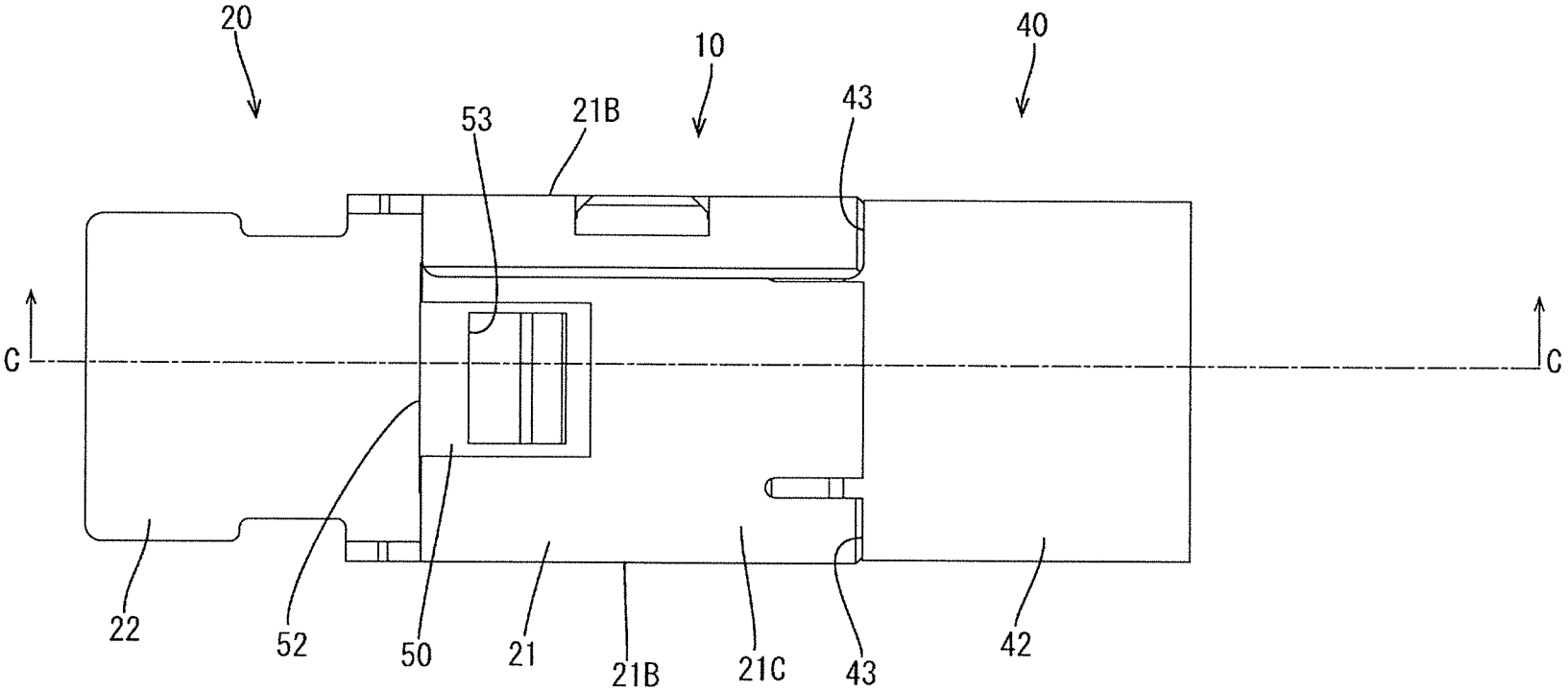
FIG. 5 is a plan view showing a state after the female terminal and the male terminal are connected.
Figure 6:
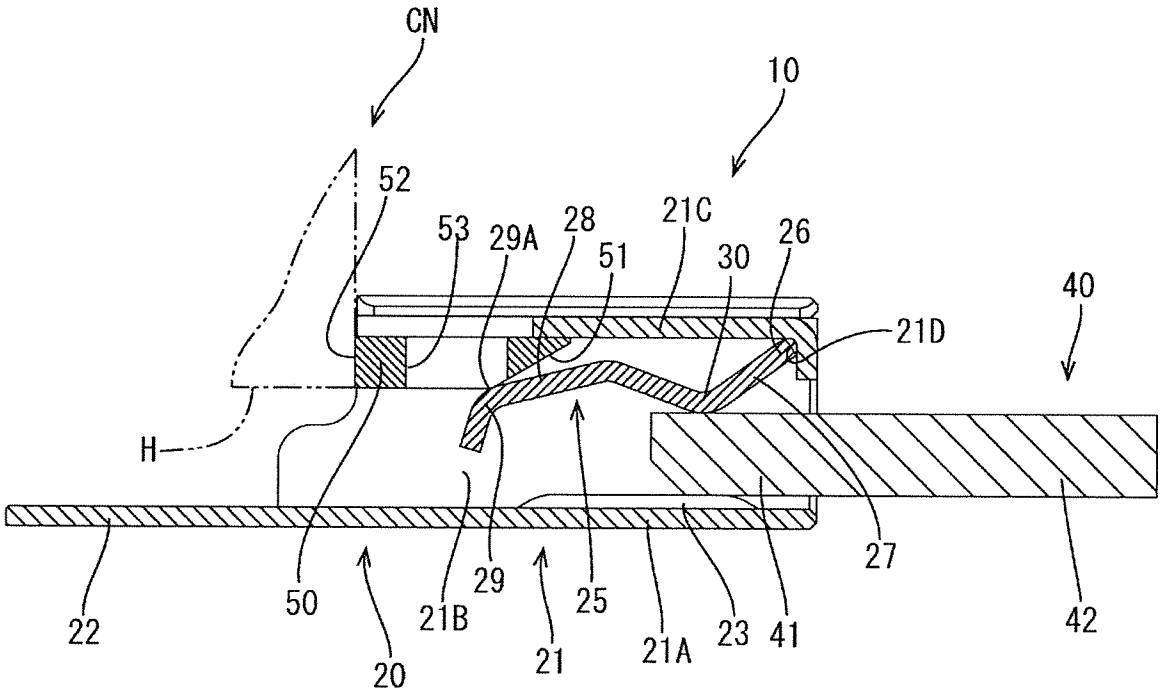
FIG. 6 is a section along C-C of FIG. 5 showing a state where a pressed portion is pressed by a pressing portion and a female contact portion is pressed against the male connecting portion.

A first embodiment is described with reference to FIGS. 1 to 6 and has a terminal connecting structure 10 used in a connector device CN, such as in a device installed in a vehicle. As shown in FIGS. 5 and 6, this connecting structure is for a female terminal 20 accommodated in a female housing H and a male terminal 40 accommodated in an unillustrated male housing. Note that, in the following description, a vertical direction is based on a vertical direction in FIG. 2. Further, a front-rear direction is based on a lateral direction in FIGS. 1 and 2 and ends of the female terminal 20 and the male terminal 40 to be connected to each other are referred to as front ends.

The male terminal 40 is formed by press-working a metal plate material that is excellent in conductivity. As shown in FIGS. 1 to 6, the male terminal 40 is configured such that an unillustrated male wire connecting portion is provided behind a flat plate-shaped male connecting portion 41, and a linking portion 42 is between the male connecting portion 41 and the male wire connecting portion. The male wire connecting portion is connected to an end of an unillustrated wire by a known connection method so that the male terminal 40 is connected to the end of the wire.

The male connecting portion 41 is narrower than the linking portion 42 in the lateral direction, and two contact surfaces 43 facing forward are formed as steps at positions on both sides in the lateral direction in a boundary part between the male connecting portion 41 and the linking portion 42.

Figure 1:
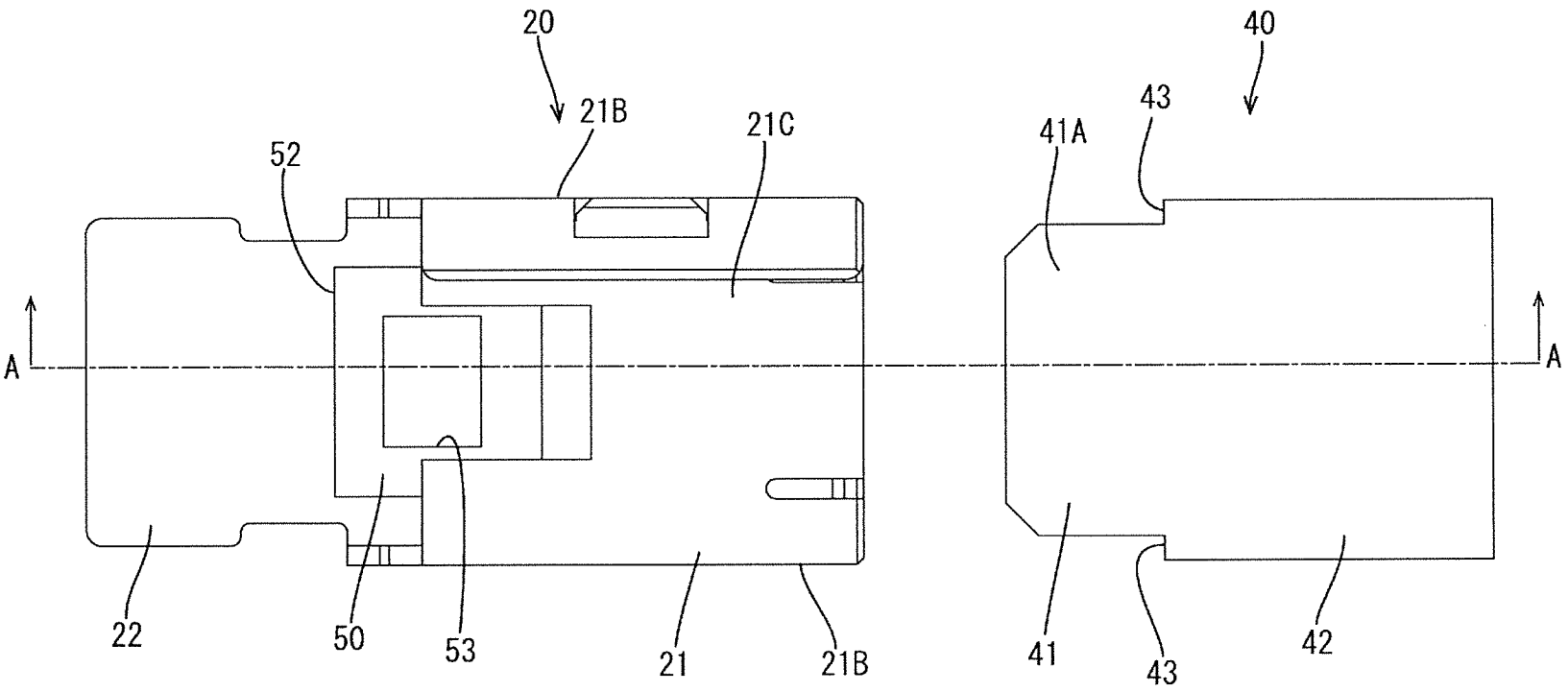
FIG. 1 is a plan view showing a state before a female terminal and a male terminal according to a first embodiment are connected.
Figure 2:
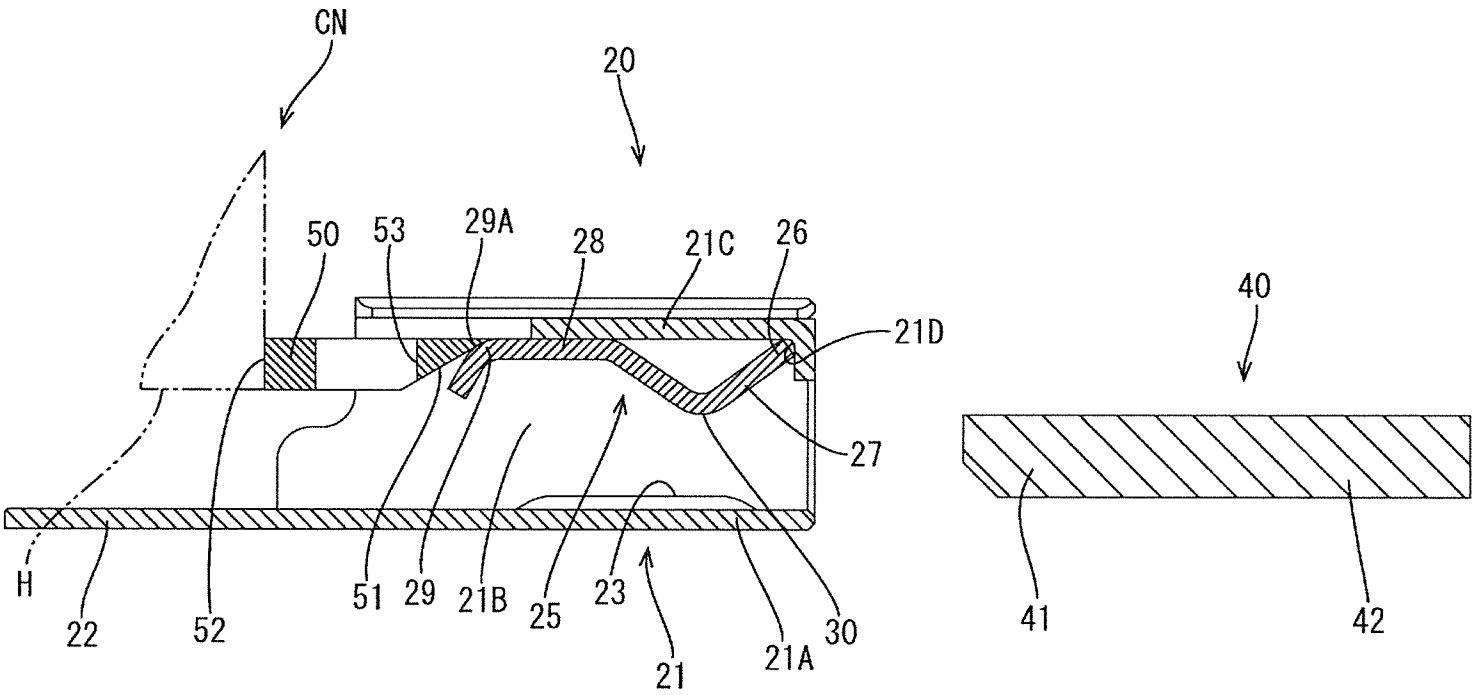
FIG. 2 is a section along A-A of FIG. 1.

On the other hand, the female terminal 20 is formed by press-working a metal plate material thinner than the male terminal 40 and excellent in conductivity. Further, as shown in FIGS. 1 and 2, the female terminal 20 includes a female connecting portion 21 connectable to the male terminal 40 and a female wire connecting portion 22 connected to and behind the female connecting portion 21. The female terminal 20 is connected to the wire by placing a core of an unillustrated wire on the female wire connecting portion 22 and connecting the core by a known connection method.

As shown in FIG. 2, the female connecting portion 21 includes a flat bottom plate 21A, two side plates 21B rising up from both lateral sides of the bottom plate 21A and a flat ceiling plate 21C linking the upper edges of the side plates 21B in the lateral direction to define a rectangular tube that is open forward and rearward.

Figure 3:
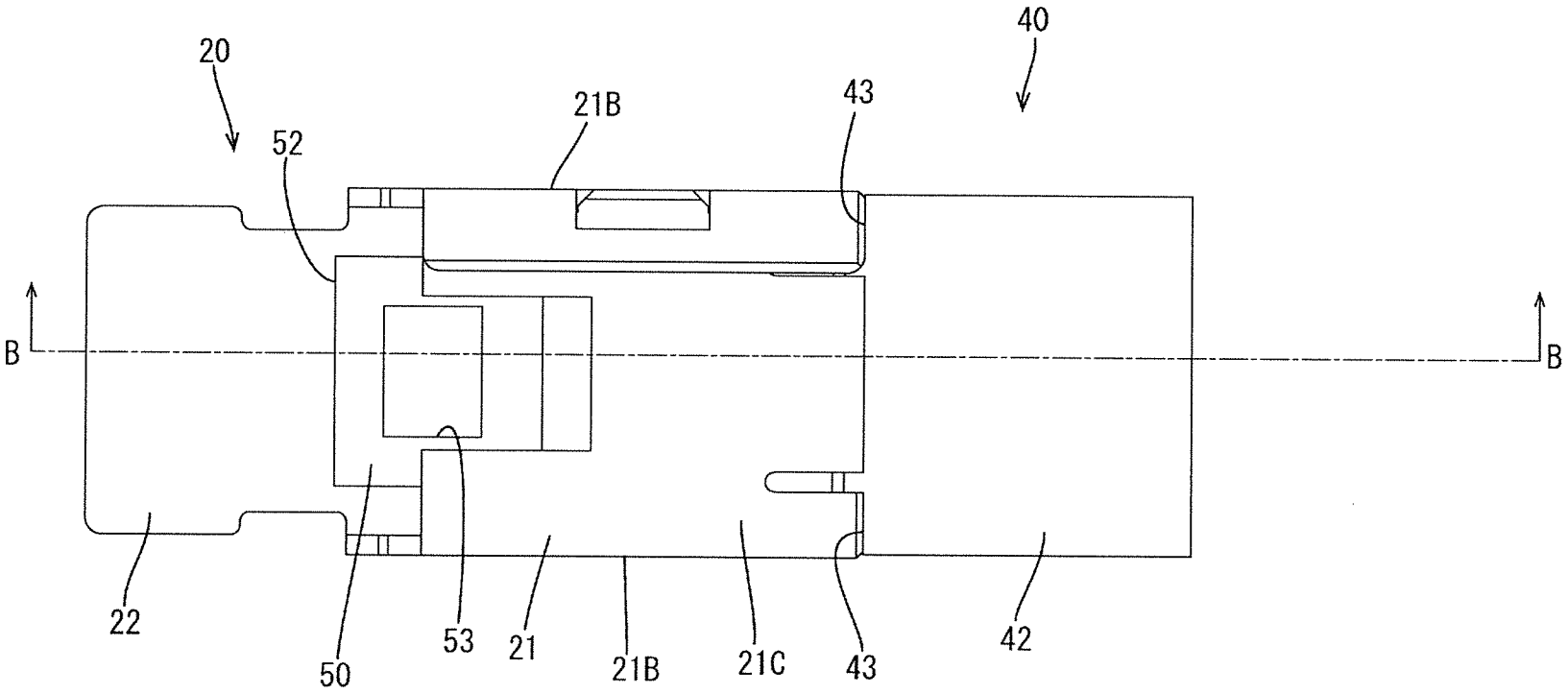
FIG. 3 is a plan view showing a state where a male connecting portion is inserted in a female connecting portion.

As shown in FIGS. 1 to 4, the male connecting portion 41 can be inserted into and retracted from the female connecting portion 21 through a front end opening. When being inserted to a proper insertion position into the female connecting portion 21, the male connecting portion 41 is placed on a placing portion 23 that protrudes up from the bottom plate 21A of the female connecting portion 21 and extends in the front-rear direction. Further, when the male connecting portion 41 is inserted to the proper insertion position into the female connecting portion 21, the two contact surfaces 43 of the male connecting portion 41 contact a front end opening edge of the female connecting portion 21, as shown in FIG. 3, so that the male connecting portion 41 is stopped in front.

Figure 4:
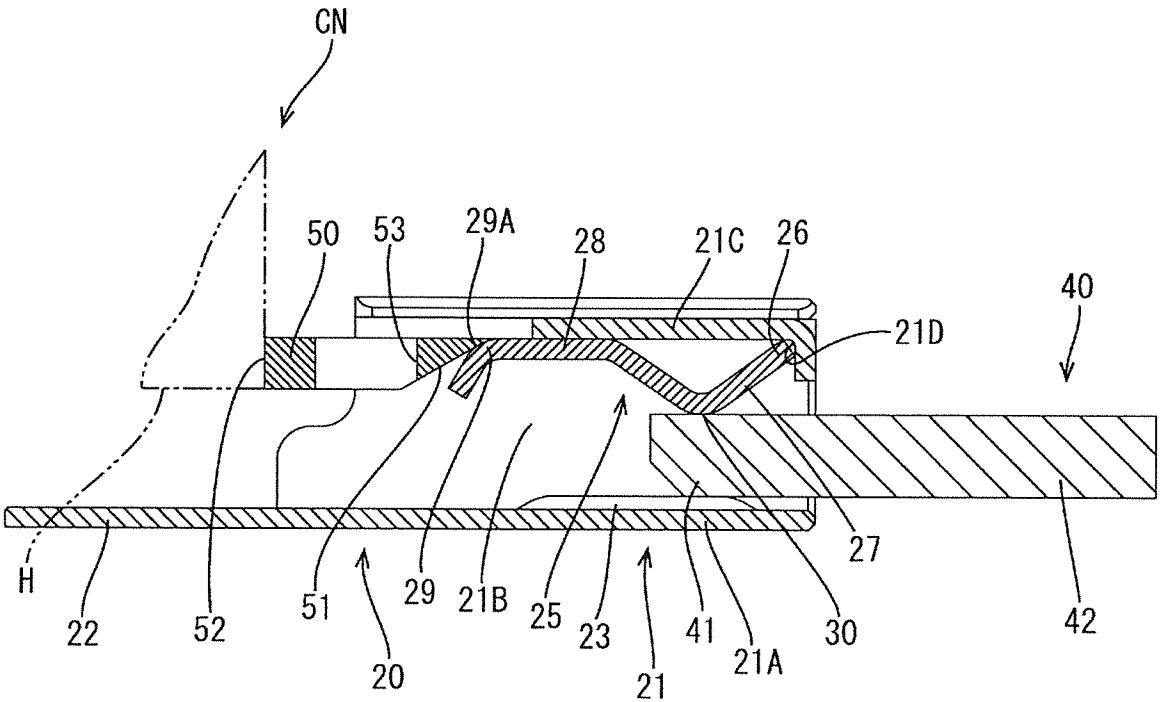
FIG. 4 is a section along B-B of FIG. 3.

A separate movable piece 25 is fixed to an upper edge part 21D of the front end opening of the female connecting portion 21, as shown in FIGS. 2, 4 and 6, and configured to be pressed by a pressing portion 50 and displaced resiliently down.

As shown in FIGS. 2, 4 and 6, the movable piece 25 is connected to the upper edge 21D on the front end opening of the female connecting portion 21 in a state electrically connected to the ceiling plate 21C of the female connecting portion 21. Further, the movable piece 25 is cantilevered rearward from the upper edge 21D and resiliently displaceable down with a supporting portion 26 connected to the ceiling plate 21C as a support.

As shown in FIGS. 2 and 4, the movable piece 25 includes a chevron-shaped portion 27 protruding down from the front end opening of the female connecting portion 21 in a natural state where the movable piece 25 is not resiliently displaced, an extending portion 28 extending straight rearward from the rear end of the chevron-shaped portion 27 and a pressed portion 29 provided on a rear end part of the extending portion 28.

A projecting end part is a lowermost part of the chevron-shaped portion 27 and forms a female contact portion 30 disposed above the placing portion 23 on the bottom plate 21A, as shown in FIG. 2. Tin plating having lower electrical resistance than nickel plating is, for example, applied to this female contact portion 30.

In the natural state where the movable piece 25 is not resiliently displaced, the female contact portion 30 is in a non-pressing state. Thus, the female contact portion 30 contacts an upper surface 41A of the male connecting portion 41 being inserted into the female connecting portion 21, but does not press the male connecting portion 41, as shown in FIG. 4. The movable piece 25 is displaced resiliently down when the male connecting portion 41 is at the proper position in the female connecting portion 21. Thus, the female contact portion 30 is set in a pressing state where the female contact portion 30 is not displaced in the female connecting portion 21, but presses the upper surface 41A of the male connecting portion 41 in a downward direction, which is a direction perpendicular to the front-rear direction along which the male connecting portion 41 is inserted and retracted, as shown in FIG. 6.

Accordingly, if the movable piece 25 is displaced resiliently down with the male connecting portion 41 disposed at the proper position in the female connecting portion 21, the female contact portion 30 sandwiches the male connecting portion 41 from both upper and lower sides together with the placing portion 23 of the bottom plate 21A. Thus, the male connecting portion 41 and the female connecting portion 21 are connected electrically.

As shown in FIG. 2, the pressed portion 29 is bent obliquely down from the rear end part of the extending portion 28, and an arcuately curved surface on an oblique upper rear side of the pressed portion 29 defines a pressed surface 29A that can be pressed forward by the pressing portion 50. That is, a distance from the pressed portion 29 to the support 26 serving as a support of the movable piece 25 is longer than a distance from the female contact portion 30 to the support 26. Note that the pressed surface 29A on the pressed portion 29 has enhanced wear resistance, such as by having nickel plating applied thereto.

On the other hand, as shown in FIGS. 1 and 2, the pressing portion 50 is a substantially flat rectangular metal plate, and a lower part of the front end of the pressing portion 50 forms into a pressing surface 51 inclined up toward the front. Further, the pressing portion 50 is disposed along the ceiling plate 21C between the two side plates 21B in the female connecting portion 21, and is displaceable in the front-rear direction along the placing portion 23 between an initial position where a rear part of the pressing portion 50 projects rearward from a rear end opening of the female connecting portion 21, as shown in FIGS. 1 to 4, and an end position where the pressing portion 50 is accommodated completely in the female connecting portion 21, as shown in FIGS. 5 and 6. Note that the pressing portion 50 is held displaceably in the front-rear direction, for example, by an unillustrated holding mechanism provided between the two side plates 21B in the female connecting portion 21.

The rear surface of the pressing portion 50 forms a pressing operation surface 52 that is perpendicular to plate surfaces of the pressing portion 50. As shown in FIG. 6, the pressing portion 50 can be displaced from the initial position to the end position by bringing the female housing H from behind and into contact with the pressing operation surface 52 of the pressing portion 50 that is disposed at the initial position, pressing the female terminal 20 against the female housing H from the front and relatively displacing the pressing portion 50 toward the inside of the female connecting portion 21. Further, the pressing portion 50 can also be displaced from the initial position to the end position by pressing the pressing operation surface 52 forward by an unillustrated tool or the like and displacing the pressing portion 50 toward the inside of the female connecting portion 21.

Further, with the pressing portion 50 disposed at the initial position, the tip of the pressing portion 50 is in contact with the pressed surface 29A of the pressed portion 29 of the movable piece 25 from behind without pressing the pressed surface 29A, as shown in FIG. 2. In the process of displacing the pressing portion 50 from the initial position to the end position, the pressed surface 29A of the pressed portion 29 is pressed from behind by the pressing surface 51 of the pressing portion 50, and the pressed portion 29 moves onto the pressing portion 50 while the pressed surface 29A and the pressing surface 51 slide against each other. When the pressing portion 50 reaches the end position, as shown in FIG. 6, the pressed portion 29 is completely on the pressing portion 50 and the movable piece 25 is displaced resiliently down with the supporting portion 26 as a support.

Further, as shown in FIGS. 1 to 6, a substantially rectangular operation hole 53 penetrates the pressing portion 50 in the vertical direction, which is a plate thickness direction. By inserting an unillustrated tool or the like into this operation hole 53 and pressing the pressing portion 50 rearwardly, the pressing portion 50 can be returned from the end position to the initial position.

Although the pressing portion 50 is held in the female connecting portion 21 according to this embodiment, a pressing portion may be fixed integrally to a wall of a female housing as a modification. In this case, when a female terminal is accommodated into the female housing, the pressing portion is disposed at an initial position. By pressing the female terminal against the female housing from the front and relatively displacing the pressing portion forwardly with respect to a female connecting portion, the pressing portion is disposed at an end position. More particularly, the pressing portion is integral with the female housing and can be displaced in the front-rear direction with respect to the female connecting portion between the initial position and the end position. Thus, the pressed portion can be pressed by the pressing portion without using a dedicated tool or the like.

A connection method for the female terminal 20 and the male terminal 40 and functions and effects of the terminal connecting structure 10 are described in the following paragraphs.

First, as shown in FIGS. 1 and 2, the female terminal 20 and the male terminal 40 are arranged opposite to each other with the pressing portion 50 in the female connecting portion 21 of the female terminal 20 disposed at the initial position. The male connecting portion 41 of the male terminal 40 then is inserted into the female connecting portion 21 of the female terminal 20.

In this process of inserting the male connecting portion 41, the male connecting portion 41 contacts the female contact portion 30 of the chevron-shaped portion 27 in the movable piece 25 and the placing portion 23 of the bottom plate 21A when the insertion of the male connecting portion 41 into the female connecting portion 21 is started. When the male connecting portion 41 reaches the proper position in the female connecting portion 21, the two contact surfaces 43 of the male connecting portion 41 contact the front end opening edge of the female connecting portion 21, as shown in FIGS. 3 and 4. Thus, the male connecting portion 41 is stopped in front and placed on the placing portion 23 of the bottom plate 21A.

At this stage of the connection, the movable piece 25 is in the natural state without being resiliently displaced. Thus, the female contact portion 30 of the chevron-shaped portion 27 is in the non-pressing state. More particularly, the female contact portion 30 contacts the upper surface 41A of the male connecting portion 41 disposed in the female connecting portion 21, but does not press the male connecting portion 41, as shown in FIG. 4.

When the male connecting portion 41 is disposed at the proper position in the female connecting portion 21, the pressing operation surface 52 of the pressing portion 50 is pressed against the female housing H from the front or the pressing operation surface 52 of the pressing portion 50 is pressed forward by the tool.

The pressing portion 50 then is displaced forwardly with respect to the female connecting portion 21 from the initial position to the end position. In this process of displacing the pressing portion 50, the pressed surface 29A of the pressed portion 29 is pressed from behind by the pressing surface 51 of the pressing portion 50, and the pressed portion 29 moves onto the pressing portion 50 while the pressed surface 29A and the pressing surface 51 slide against each other.

When the pressing portion 50 reaches the end position, the pressed portion 29 is completely on the pressing portion 50 and the movable piece 25 is displaced resiliently down with the support 26 as a supporting point, as shown in FIG. 6. Then, the female contact 30 of the chevron-shaped portion 27 of the movable piece 25 in the non-pressing state is set in the pressing state where the female contact portion 30 is not displaced in the female connecting portion 21, but presses the upper surface 41A of the male connecting portion 41 from above. The female contact portion 30 pressing the upper surface 41A of the male connecting portion 41 down sandwiches the male connecting portion 41 from both upper and lower sides together with the placing portion 23 of the bottom plate 21A, thereby configuring the connecting structure 10 in which the female terminal 20 and the male terminal 40 are connected electrically.

As described above, according to this embodiment, the male connecting portion 41 of the male terminal 40 is inserted into the female connecting portion 21 in the state where the male connecting portion 41 contacts the female contact 30 of the female terminal 20, but is not pressed by the female contact 30. After the male connecting portion 41 reaches the proper position in the female connecting portion 21, the female contact 30 is pressed against the male connecting portion 41, thereby entering the pressing state. That is, since parts that slide in the pressing state are limited to the pressed surface 29A of the pressed portion 29 and the pressing surface 51 of the pressing portion 50, the female contact 30 of the female terminal 20 and the male connecting portion 41 of the male terminal 40 do not slide against each other and do not wear. In this way, connection reliability between the terminals 20, 40 can be ensured by applying inexpensive tin plating having relatively low electrical resistance to the female contact portion 30 without using expensive silver plating or the like.

Further, although the pressed portion 29 and the pressing portion 50 slide while being pressed against each other, both are formed of metal and the nickel plating having high wear resistance is applied to the pressed surface 29A of the pressed portion 29. Thus, the wear of the pressing portion 50 and the pressed portion 29 can be suppressed, for example, as compared to the case where a pressing portion is formed of synthetic resin or the like and nickel plating is applied to a pressed portion. In this way, a reduction of a force for pressing the pressed portion 29 due to the wear of the pressing portion 50 and the pressed portion 29 can be suppressed.

Further, since the distance from the support 26 of the movable piece 25 to the pressed portion 29 is longer than the distance from the support 26 to the female contact portion 30, the female contact portion 30 is pressed against the male connecting portion 41 by the principle of leverage if the pressed portion 29 is pressed by the pressing portion 50 and the movable piece 25 is displaced resiliently down with the support 26 as a supporting point.

That is, a contact pressure between the terminals 20 and 40 can be increased, for example, as compared to the case where a male terminal is inserted into a female terminal including a resilient contact piece to be brought resiliently into contact with the resilient contact piece. Further, the contact pressure between the terminals 20 and 40 easily can be increased, for example, as compared to the case where the distance from the support to the pressed portion is equal to or shorter than the distance from the support to the female contact portion.

Further, since the pressing portion 50 is displaced in the front-rear direction, which is the same as the inserting/retracting direction of the male connecting portion, in the female connecting portion 21, the connecting structure for the terminals can be miniaturized, for example, as compared to the case where the pressing portion is displaced vertically between the inside and outside of the female connecting portion.

Second Embodiment

A second embodiment is described with reference to FIGS. 7 to 12 and has a female terminal 120 in a terminal connecting structure 110. The shape of the ceiling plate 21C of the female connecting portion 21, the shape of the movable piece 25 and the shape of the pressing portion 50 in the first embodiment are changed. Components, functions and effects common to the first embodiment are not described to avoid repeated description. Further, the same components as in the first embodiment are denoted by the same reference signs.

Figure 7:
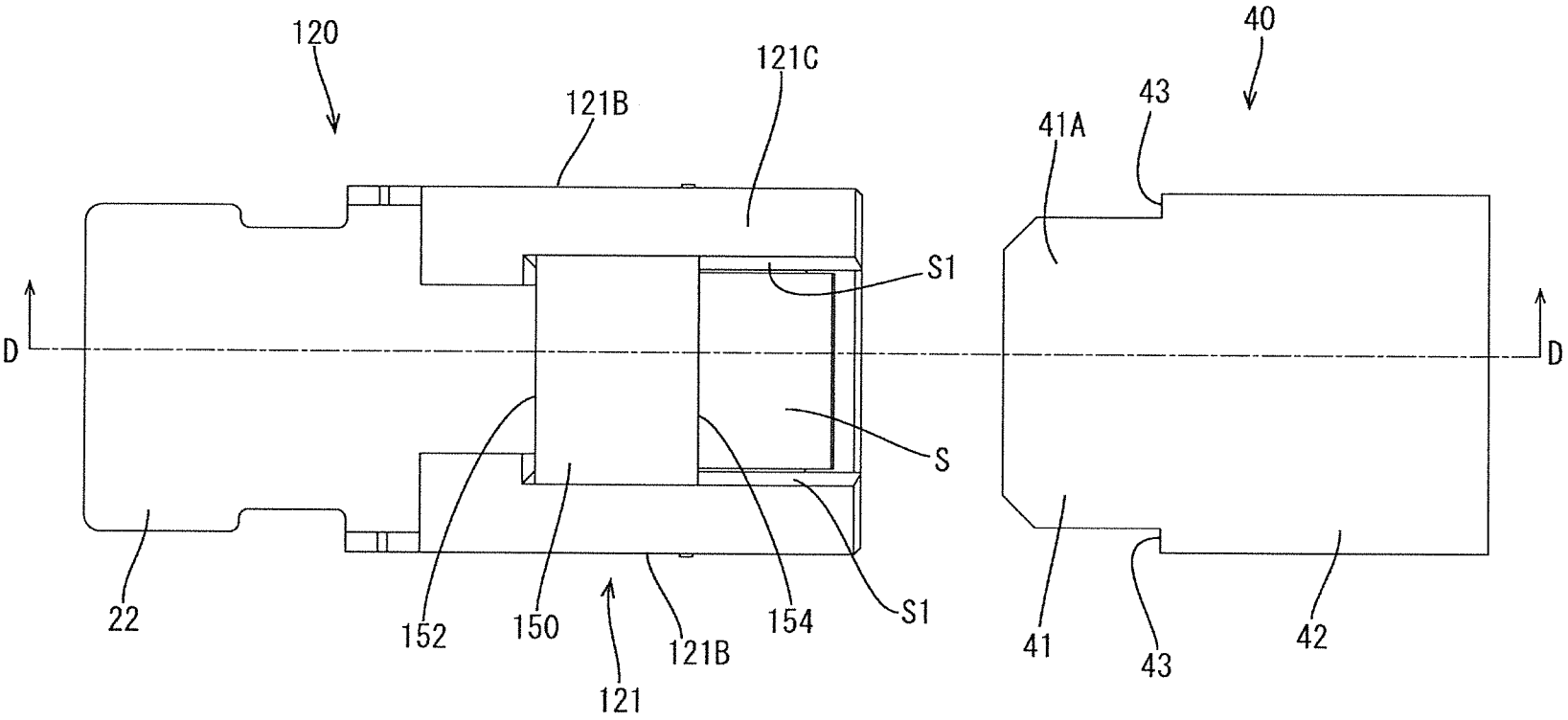
FIG. 7 is a plan view showing a state before a female terminal and a male terminal according to a second embodiment are connected.
Figure 9:
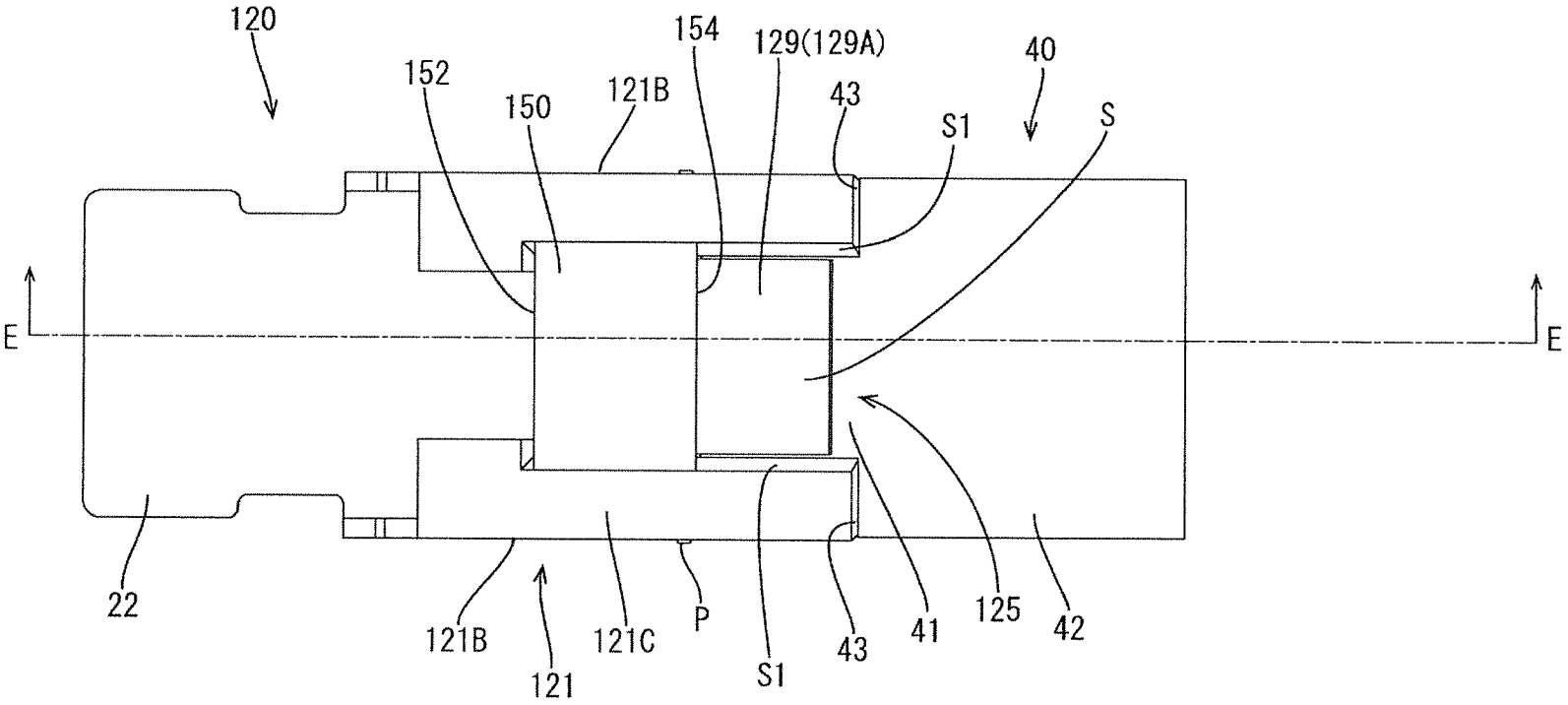
FIG. 9 is a plan view showing a state where a male connecting portion is inserted in a female connecting portion.
Figure 11:
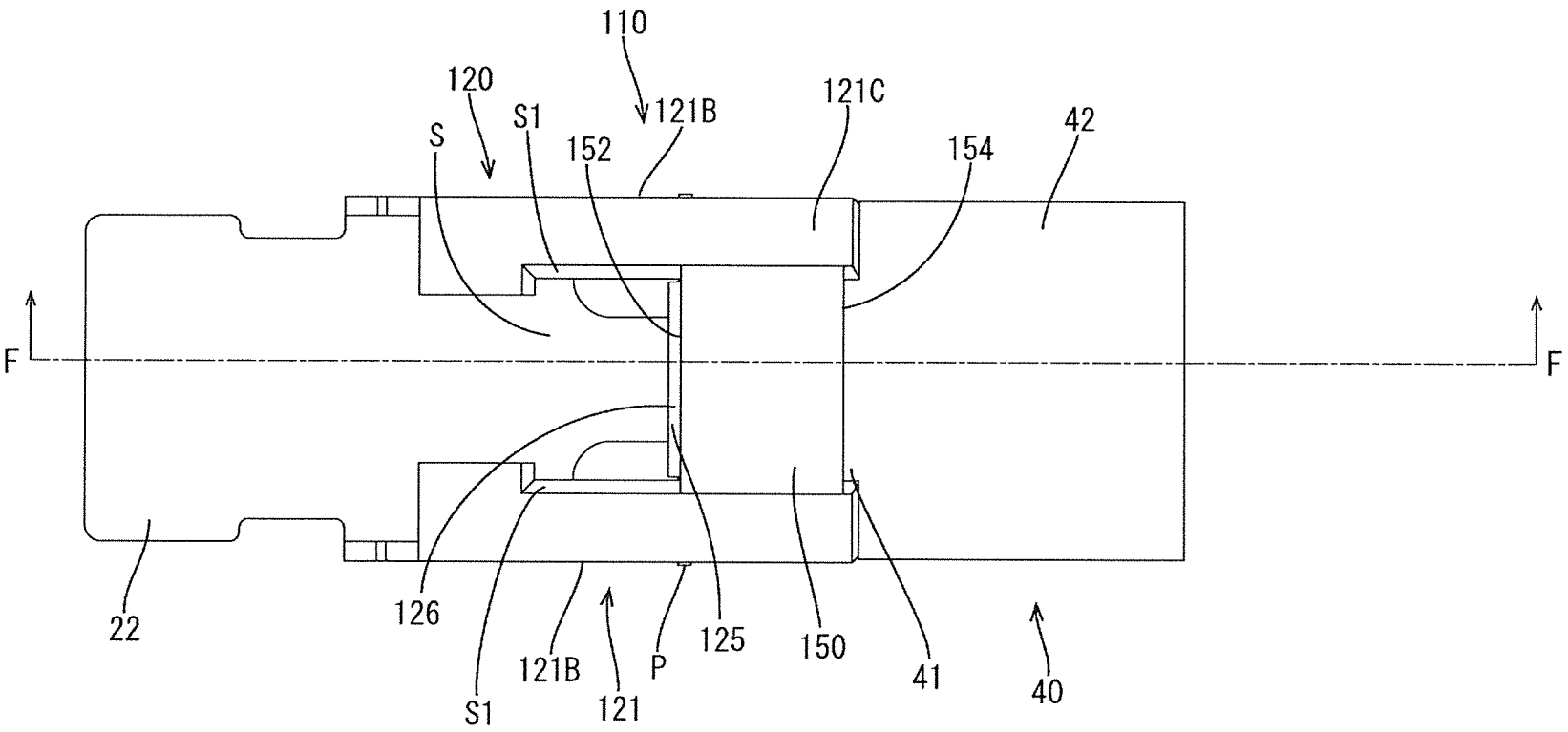
FIG. 11 is a plan view showing a state after the female terminal and the male terminal are connected.

A ceiling plate 121C in a female connecting portion 121 of the second embodiment is formed with a slit S extending in the front-rear direction over the entire length of the ceiling plate 121C, as shown in FIGS. 7, 9 and 11. In other words, the ceiling plate 121C is divided into left and right sides by the slit S.

Figure 8:
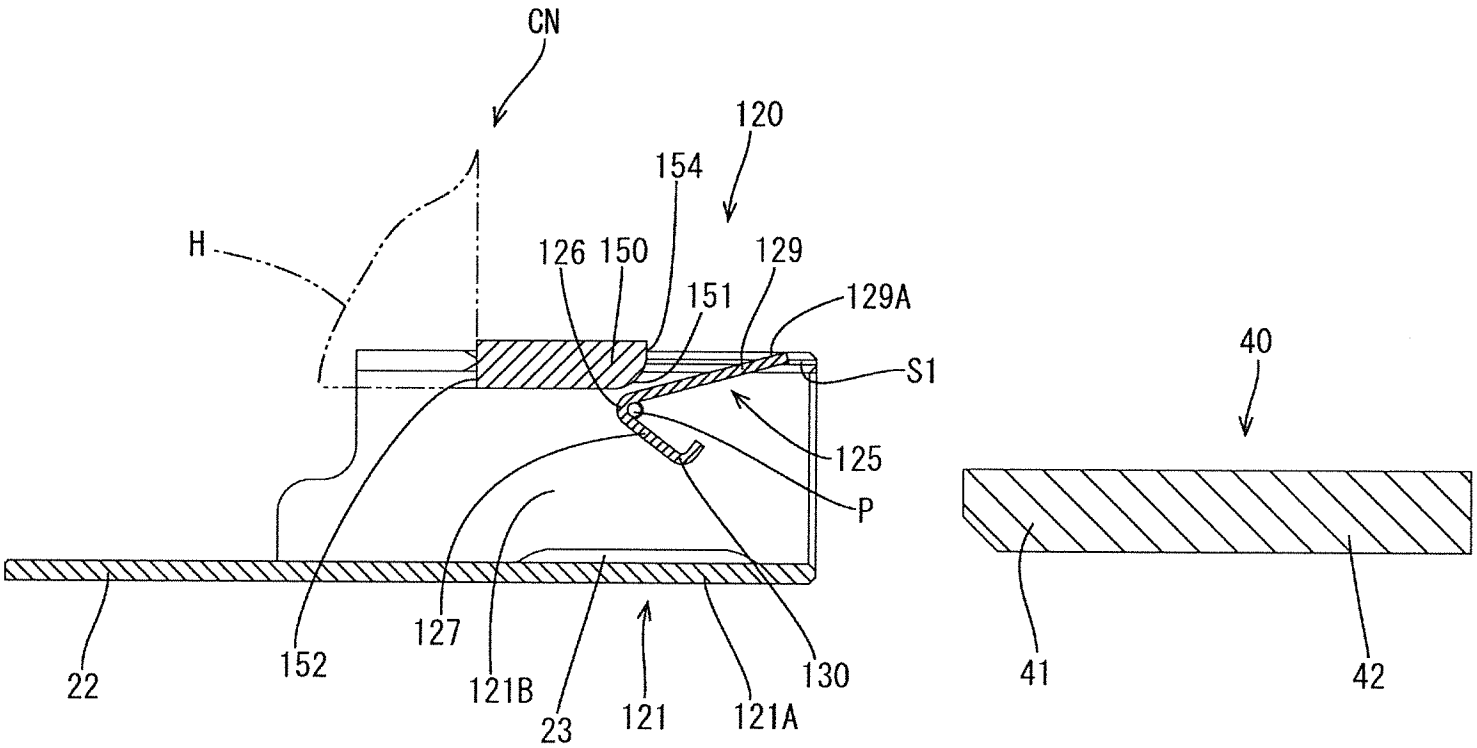
FIG. 8 is a section along D-D of FIG. 7.
Figure 10:
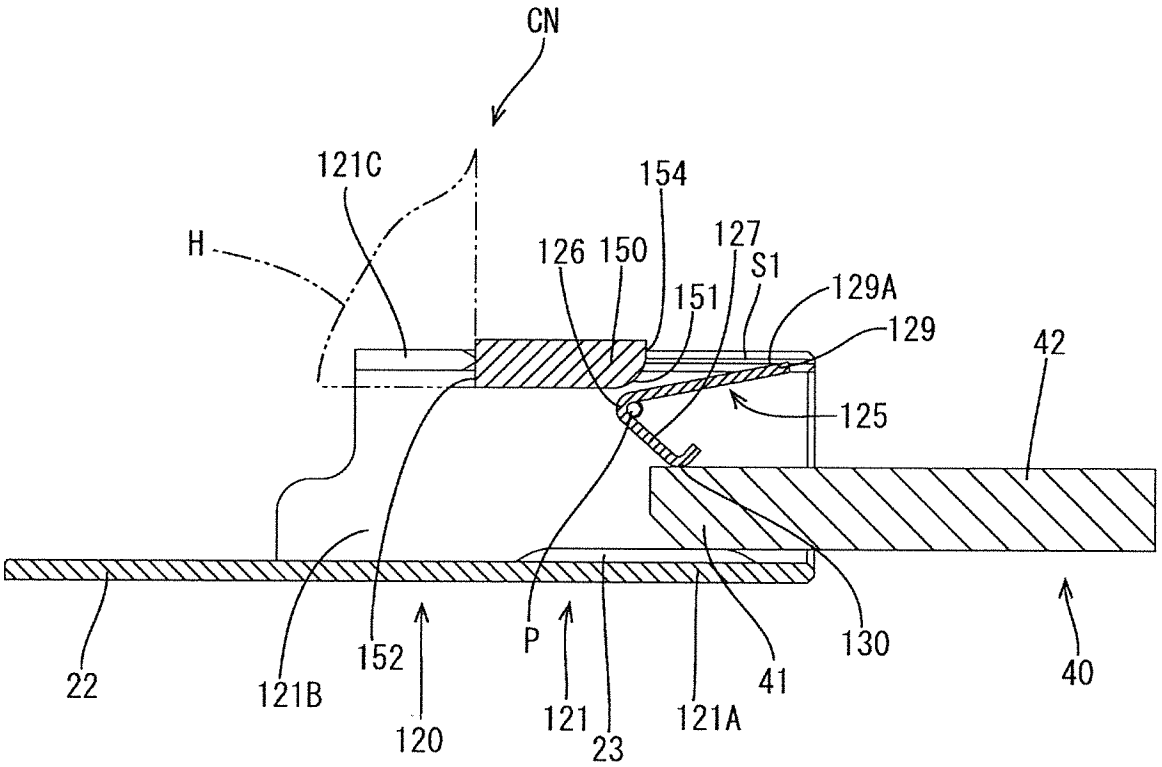
FIG. 10 is a section along E-E of FIG. 9.
Figure 12:
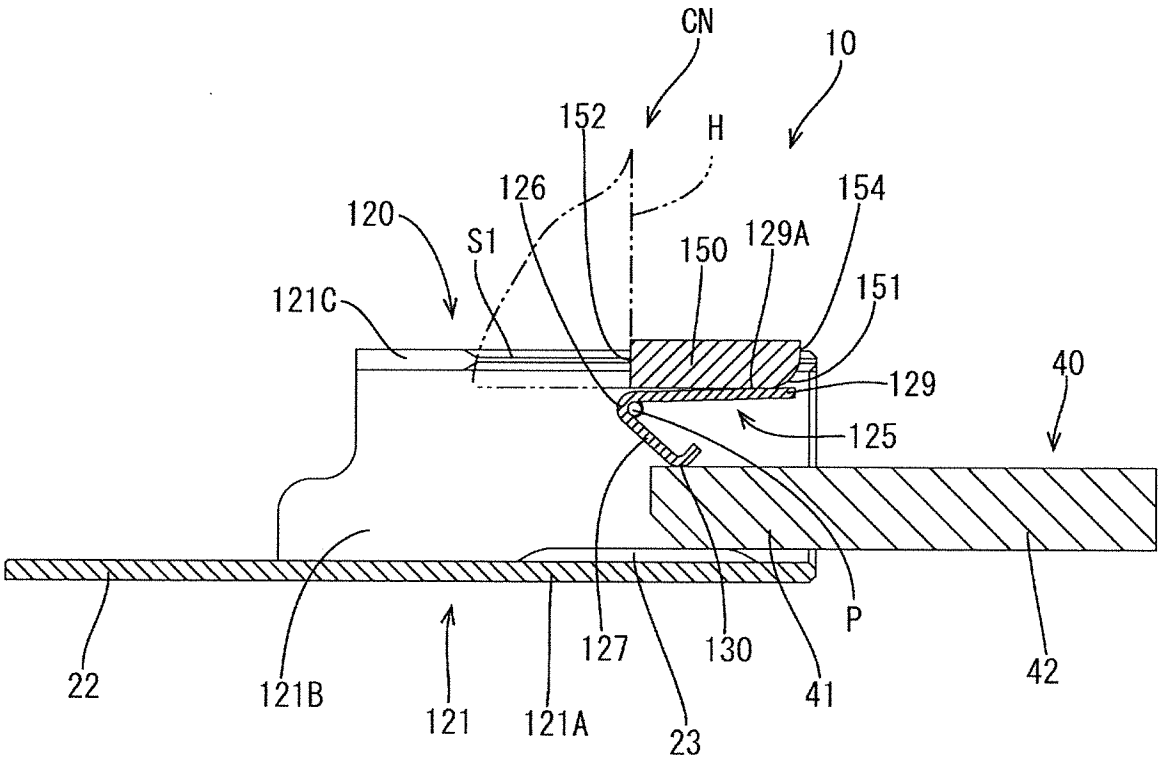
FIG. 12 is a section along F-F of FIG. 11 showing a state where a pressed portion is pressed by a pressing portion and a female contact portion is pressed against the male connecting portion.

A movable piece 125 is in the form of a plate bent at an acute angle and is held rotatably on two side plates 121B of the female connecting portion 121 by a supporting pin P as shown in FIGS. 8, 10 and 12. The supporting pin P is a long and narrow round pin disposed between the two side plates 121B, and fixed at such height positions slightly below the ceiling plate 121C in substantially central parts of the side plates 121B in the front-rear direction.

The movable piece 125 includes a bent portion 126 bent at an acute angle and supported on the supporting pin P, a pressed piece 129 obliquely extending straight toward a front-upper side from the bent portion 126 in a natural state where the movable piece 125 is not resiliently displaced, and a contact piece 127 having a length shorter than the pressed piece 129 in the front-rear direction and obliquely extending straight from the bent portion 126 toward a front-lower side.

As shown in FIGS. 8 and 10, the pressed piece 129 extends from the bent portion 126 into the slit S in the ceiling plate 121C of the female connecting portion 121 and the rear surface of the pressed piece 129 serves as a pressed surface 129A to be pressed by a pressing portion 150.

As shown in FIGS. 7, 9 and 11, the pressing portion 150 is a plate substantially rectangular in a plan view and a lower end part of the front end edge thereof serves as a rounded pressing curved surface 151. Further, an unillustrated pair of fitting recesses are provided on both lateral sides of the pressing portion 150 for supporting the pressing portion 150 displaceably in the front-rear direction with respect to the female connecting portion 121 by being respectively fit to side edge parts 51 of the slit S in the ceiling plate 121C of the female connecting portion 21.

Accordingly, the pressing portion 150 is displaceable forward and rearward between an initial position where the pressing portion 150 is disposed substantially in a central part of the ceiling plate 121C in the front-rear direction and an end position where the pressing portion 150 is disposed on a front side of the ceiling plate 121C, as shown in FIGS. 7 to 12 by sliding the two fitting recesses forward and rearward with respect to the two side edge parts 51 of the slit S of the ceiling plate 121C.

As shown in FIGS. 7 to 12, the rear surface of the pressing portion 150 serves as a pressing operation surface 152, whereas the front surface thereof serves as a releasing operation surface 154. For example, the pressing portion 150 is displaced toward the inside of the female connecting portion 121 by pressing the pressing operation surface 152 forward from a rear side by an unillustrated tool or the like, and the pressing portion 150 can be displaced from the end position to the initial position by pressing the releasing operation surface 154 rearward from a front side.

In the process of displacing the pressing portion 150 from the initial position to the end position, the pressing curved surface 151 of the pressing portion 150 comes into contact from behind with the pressed surface 129A of the pressed piece 129 of the movable piece 125 disposed in the slit S. When the pressing portion 150 reaches the end position, the pressing curved surface 151 of the pressing portion 150 presses the pressed surface 129A of the pressed piece 129 from behind, as shown in FIG. 12. Thus, the pressed piece 129 is displaced rotationally about the supporting pin P until becoming substantially horizontal.

On the other hand, as shown in FIG. 8, a lower end part of the contact piece 127 is bent obliquely bent toward a front-upper side, and this bent part serves as a female contact 130 connectable to an upper surface 41A of a male connecting portion 41. In a state where the movable piece 125 is not pressed by the pressing portion 150, the female contact 130 is in a non-pressing state where the female contact portion 130 contacts the upper surface 41A of the male connecting portion 41 being inserted into the female connecting portion 121, but does not press the male connecting portion 41, as shown in FIG. 10.

In a state where the male connecting portion 41 is at a proper position in the female connecting portion 121, the pressed piece 129 of the movable piece 125 is pressed from behind by the pressing portion 150 and is displaced until becoming substantially horizontal, as shown in FIG. 12. Thus, the contact piece 127 is pressed down by the principle of leverage with the supporting pin P as a supporting point. In this way, the female contact portion 30 is set in a pressing state where the female contact portion 30 is not displaced in the female connecting portion 121, but presses the upper surface 41A of the male connecting portion 41 down.

That is, also in this embodiment, parts that slide in the pressing state in the female terminal 120 are limited to the pressed surface 129A of the pressed piece 129 and the pressing surface 151 of the pressing portion 150. Thus, the female contact 130 of the female terminal 120 and the male connecting portion 41 of the male terminal 40 do not slide against each other and do not wear.

Further, since a length of the pressed piece 129 of the movable piece 125 is longer than that of the contact piece 127, if the pressed piece 129 is pressed by the pressing portion 150 and rotationally displaced down around the supporting pin P, the female contact portion 130 is pressed against the male connecting portion 41 by the principle of leverage, as shown in FIG. 12. Thus, a contact pressure between the terminals 120, 40 can be increased.

Other Embodiment

The invention is not limited to the above described and illustrated embodiments. For example, the following modes also are included.

In the first embodiment, the separate movable piece 25 is connected to the female connecting portion 21. However, without limitation to this, a movable piece may be formed integrally to a female connecting portion by folding a metal piece extending rearward from the front end of the female connecting portion.

In the above-described embodiments, the female contact portion 30, 130 contacts the female connecting portion 41 in the process of inserting the male connecting portion 41 into the female connecting portion 21, 121. However, the female contact portion may not contact the male connecting portion in the process of inserting the male connecting portion into the female connecting portion.

In the above-described embodiments, the pressed portion 29 or the pressed piece 129 is pressed by the pressing portion 50, 150 configured to be displaced in the front-rear direction. However, without limitation to this, a pressed portion may be pressed by a pressing portion configured to be displaced in the vertical direction or a pressing portion configured to be displaced in the lateral direction.

LIST OF REFERENCE SIGNS

10: terminal connecting structure
20, 120: female terminal
21, 121: female connecting portion
21A, 121A: bottom plate
25, 125: movable piece (example of "movable portion")
26: support
29: pressed portion
30, 130: female contact
40: male terminal
41: male connecting portion
50, 150: pressing portion
129: pressed piece (example of "pressed portion")
CN: connector device
P: supporting pin (example of "supporting portion")

The invention claimed is:

1. A connector device, comprising:

a male terminal including a male connecting portion;

a female terminal formed from a conductive material and including a female connecting portion with opposite front and rear ends and opposite bottom and top plates extending rearward from the front end of the female connecting portion, the male connecting portion being insertable into and retractable from the front end of the female connecting portion, the inserted male connecting portion being placed on the bottom plate of the female connecting portion;

a movable portion supported in an electrically connected state to the female connecting portion by a support provided on the top plate at the front end of the female connecting portion, the movable portion being displaceable between the top and bottom plates with the support as a supporting portion;

a female contact provided on the movable portion, the female contact being displaceable between a non-pressing state where the female contact does not press the male connecting portion being inserted into the front end of the female connecting portion and a pressing state where the female contact presses the male connecting portion placed on the bottom plate of the female connecting portion in a direction intersecting an inserting/retracting direction of the male connecting portion and toward the bottom plate of the female connecting portion;

a pressed portion pressably provided at a position of the movable portion where a distance from the support to the pressed portion is longer than a distance between the support and the female contact, the pressed portion displacing the female contact from the non-pressing state to the pressing state with the support as a supporting portion by being pressed; and a pressing portion displaceable toward the front end of the female connecting portion from an initial position where the pressing portion does not press the pressed portion to an end position where the pressing portion presses the pressed portion and causes the female contact to displace toward the bottom plate of the female connecting portion relative to the support provided on the top plate at the front end of the female connecting portion.

2. The connector device of claim 1, wherein the pressing portion is displaced relative to bottom plate of the female connecting portion on which the male connecting portion is placed.

3. The connector device of claim 1, wherein the pressing portion is formed of metal.

4. The connector device of claim 1, wherein the pressing portion is supported displaceably in directions in which the male connecting portion is inserted into and retracted from the female connecting portion.

5. The connector device of claim 1, wherein the pressing portion is formed of metal.

6. The connector device of claim 5, wherein the pressing portion is supported displaceably in directions in which the male connecting portion is inserted into and retracted from the female connecting portion.

* * * * *